US009190768B2

(12) United States Patent
Ikeya et al.

(10) Patent No.: US 9,190,768 B2
(45) Date of Patent: Nov. 17, 2015

(54) CONNECTOR HAVING A FIRST SEAL AND A SECOND SEAL AND A PRESSING RIB

(71) Applicants: Yazaki Corporation, Minato-ku, Tokyo (JP); ADVICS CO., LTD., Kariya-shi, Aichi (JP)

(72) Inventors: Kenichi Ikeya, Susono (JP); Shinichiro Yukoku, Seto (JP)

(73) Assignees: Yazaki Corporation, Tokyo (JP); ADVICS CO., LTD., Kariya-Shi (JP)

( * ) Notice: Subject to any disclaimer, the term of this patent is extended or adjusted under 35 U.S.C. 154(b) by 0 days.

(21) Appl. No.: 14/524,510

(22) Filed: Oct. 27, 2014

(65) Prior Publication Data

US 2015/0118881 A1 Apr. 30, 2015

(30) Foreign Application Priority Data

Oct. 28, 2013 (JP) ..... 2013-223242

(51) Int. Cl.

| | |
|---|---|
| ***H01R 13/52*** | (2006.01) |
| ***H01R 13/631*** | (2006.01) |
| ***H01R 13/62*** | (2006.01) |
| *H01R 12/72* | (2011.01) |
| *H01R 13/74* | (2006.01) |

(52) U.S. Cl.

CPC ..... *H01R 13/5219* (2013.01); *H01R 13/5202* (2013.01); *H01R 13/62* (2013.01); *H01R 13/6315* (2013.01); *H01R 12/724* (2013.01); *H01R 13/74* (2013.01)

(58) Field of Classification Search

USPC ..... 439/271–275, 587–589

See application file for complete search history.

(56) References Cited

U.S. PATENT DOCUMENTS 6,203,348 B1 * 3/2001 Fukuda ..... H01R 13/5208 439/271
7,828,591 B2 * 11/2010 Matsuoka ..... H01R 4/183 439/559
9,059,534 B2 * 6/2015 Endo ..... H01R 13/5205 1/1
2007/0184701 A1 * 8/2007 Yagome ..... H01R 13/506 439/271
2009/0124121 A1 * 5/2009 Matsuoka ..... H01R 4/183 439/550
2012/0196476 A1 * 8/2012 Haberek ..... H01R 9/05 439/578
2014/0302711 A1 * 10/2014 Suzuki ..... H01R 13/5202 439/556
2015/0099394 A1 * 4/2015 Ikeya ..... H01R 12/724 439/533
2015/0140850 A1 * 5/2015 Suzuki ..... H01R 9/0524 439/275

FOREIGN PATENT DOCUMENTS

JP 2013-131474 A 7/2013
WO 2013094774 A1 6/2013

OTHER PUBLICATIONS

Communication dated Feb. 12, 2015, issued by the European Patent Office in counterpart Application No. 14190442.5.

* cited by examiner

*Primary Examiner* — Chandrika Prasad
(74) *Attorney, Agent, or Firm* — Sughrue Mion, PLLC

(57) ABSTRACT

A connector includes: a case-shaped attachment member including a through-hole; a first housing including a first fitting portion accommodating a first terminal; and a second housing including a second fitting portion accommodating a second terminal. The first housing includes an outer housing and an inner housing. The inner housing is assembled to be movable in the fitting direction and is provided with the first fitting portion. The inner housing is provided with a pressing rib. Between the pressing rib and outer housing, a second seal member is provided for sealing between the outer and inner housings. A restricting portion which comes into contact with the pressing rib to restrict movement of the pressing rib in the fitting direction is provided in a side of the through-hole closer to the inside of the attachment member.

2 Claims, 8 Drawing Sheets

CONNECTOR HAVING A FIRST SEAL AND A SECOND SEAL AND A PRESSING RIB

CROSS REFERENCE TO RELATED APPLICATION

This application claims benefit of priority under 35USC119 based on Japanese Patent Application 2013-223242 filed on Oct. 28, 2013, the entire contents of which are incorporated by reference herein.

BACKGROUND OF THE INVENTION

1. Field of the Invention

The present invention relates to a connector.

2. Description of the Related Art

One of conventionally-known connectors includes an attachment wall, a first housing, a second housing, and a first seal member. The attachment wall as an attachment member includes a through-hole. The first housing is provided to one side of the attachment wall and includes a housing body as a first fitting portion accommodating a first terminal. The second housing is provided to the other side of the attachment wall and includes a pocket portion as a second fitting portion which is capable of being fitted to the housing body inserted through the through-hole and accommodates a second terminal. The first seal member is provided in close contact with the outer periphery of the first housing and comes into close contact with the through-hole for sealing the one side of the attachment wall from the other side (Japanese Patent Application Publication No. 2013-131474).

In this connector, the first housing includes: a housing which includes a supporting portion and the housing body integrated with each other, the supporting portion being fixed as a fixation portion to the attachment wall; and a spacer which is attached to the outer periphery of the housing body to be movable in a direction that the first housing is fitted to the second housing.

In the first housing, a flange having a larger diameter than that of the through-hole is provided at an end of the spacer. In the end surface of the housing to be fitted to the spacer, a flange accommodating annular groove is provided. Between the surfaces of the flange and the flange accommodating annular groove facing each other, a second seal member for sealing between the housing and spacer is provided.

SUMMARY OF THE INVENTION

In the connector as described in Japanese Patent Application Publication No. 2013-131474, when the first and second housings are fitted to each other, the flange provided for the spacer of the first housing comes into contact with an open end of the through-hole to restrict movement of the spacer in the fitting direction, and the housing body of the housing is fitted into the pocket portion of the second housing.

In this process, the second seal member is compressed by the surface of the flange with the movement restricted and the surface of the flange accommodating annular groove facing each other and comes into close contact with the surfaces of the flange and flange accommodating annular groove facing each other, thus providing sealing for waterproof between the housing and spacer.

However, in the connector described above, in the process of fitting the first housing to the second housing, the flange comes into contact with the open end of the through-hole and thereby restricts the movement of the spacer in the fitting direction. Accordingly, the movement of the housing, which is provided with the housing body, in the fitting direction has only an allowance not more than the interference of the second seal member.

For this reason, when the position of the second housing is misaligned with the attachment member in the fitting direction by more than the interference of the second seal member, the misalignment cannot be absorbed, and the first terminal accommodated in the first housing cannot be properly connected to the second terminal accommodated in the second housing.

Moreover, in the connector described above, if the spacer is designed simply to move in the fitting direction in order to absorb the misalignment of the second housing with the attachment member in the fitting direction, the flange can move, so that the second seal member cannot be brought into close contact with the surfaces of the flange and flange accommodating annular groove facing each other. The sealing performance of the second seal member is therefore reduced.

Accordingly, an object of the present invention is to provide a connector capable of ensuring the sealing performance by the second seal member while increasing the reliability in connection between the first and second terminals.

A first aspect of the present invention is a connector, including: a case-shaped attachment member including a through-hole in a sidewall; a first housing which is provided outside of the attachment member and includes a first fitting portion accommodating a first terminal, the first fitting portion being inserted through the through-hole; a second housing which is provided inside of the attachment member and includes a second fitting portion which is capable of being fitted to the first fitting portion and accommodates a second terminal; and a first seal member which is provided in close contact with an outer periphery of the first housing and is brought into close contact with the through-hole for sealing between the inside and outside of the attachment member. In the connector, the first housing includes: an outer housing provided with a fixation portion which is fixed to the sidewall of the attachment member; and an inner housing which is provided on an inner peripheral side of the outer housing to move in a fitting direction that the first housing is fitted to the second housing and includes the first fitting portion. The inner housing is provided with a pressing rib on an outer periphery of the first fitting portion, the pressing rib having an outer diameter small enough to be inserted through the through-hole and being located facing an and surface of the outer housing in the fitting direction. Moreover, a second seal member is provided between the end surface of the outer housing in the fitting direction and a surface of the pressing rib facing the end surface, the second seal member coming into close contact with the pressing rib and the end surface of the outer housing in the fitting direction for sealing between the outer housing and the inner housing. Furthermore, a restricting portion is provided in a side of the through-hole closer to the inside of the attachment member, the restricting portion being configured to come into contact with the pressing rib to restrict movement of the pressing rib in the fitting direction.

In the aforementioned connector, the first housing includes the inner housing which is provided on the inner peripheral side of the outer housing to move in the fitting direction that the first housing is fitted to the second housing, and the inner housing is provided with the pressing rib on the outer periphery of the first fitting portion, the pressing rib having an outer diameter small enough to be inserted through the through-hole and being located facing the end surface of the outer housing in the fitting direction.

Accordingly, the first fitting portion of the inner housing can move relative to the second fitting portion of the second housing in the fitting direction, thus absorbing misalignment of the second housing with the attachment member in the fitting direction. The first and second terminals can be therefore connected properly.

Moreover, the second seal member configured to come into close contact with the pressing rib and the end surface of the outer housing in the fitting direction for sealing between the outer housing and the inner housing is provided between the end surface of the outer housing in the fitting direction and a surface of the pressing rib facing the end surface.

Accordingly, when the second housing is misaligned with the attachment member toward the through hole in the fitting direction, the surfaces of the first and second fitting portions facing each other in the fitting direction come into contact to restrict the movement of the inner housing in the fitting direction. The second seal member is brought into contact with the surfaces of the pressing rib and outer housing in the fitting direction, thus ensuring the sealing performance.

Furthermore, the restricting portion configured to come into contact with the pressing rib to restrict movement of the pressing rib in the fitting direction is provided in the side of the through-hole closer to the inside of the attachment member.

Accordingly, when the second housing is misaligned with the attachment member away from the through-hole in the fitting direction, the pressing rib and restricting portion come into contact to restrict the movement of the inner housing in the fitting direction. This brings the second seal member into close contact with the surfaces of the pressing rib and outer housing facing each other in the fitting direction, thus ensuring the sealing performance of the second seal.

Consequently, in the thus-configured connector, the sealing performance of the second seal member is ensured while misalignment of the second housing with the attachment member in the fitting direction is absorbed to increase the reliability in connection between the first and second terminals.

The restricting portion may be formed into a flange thinner than the sidewall at an open end of the through-hole closer to the inside of the attachment member.

In this connector, the restricting portion is formed into a flange thinner than the sidewall at the open end of the through-hole closer to the inside of the attachment member. Accordingly, the restricting portion does not protrude into the attachment member and cannot influence the arrangement space within the attachment member.

According to the first aspect of the present invention, it is possible to provide a connector capable of ensuring the sealing performance of the second seal member while increasing the reliability in connection between the first and second terminals.

DESCRIPTION OF THE EMBODIMENTS

Figure 1:
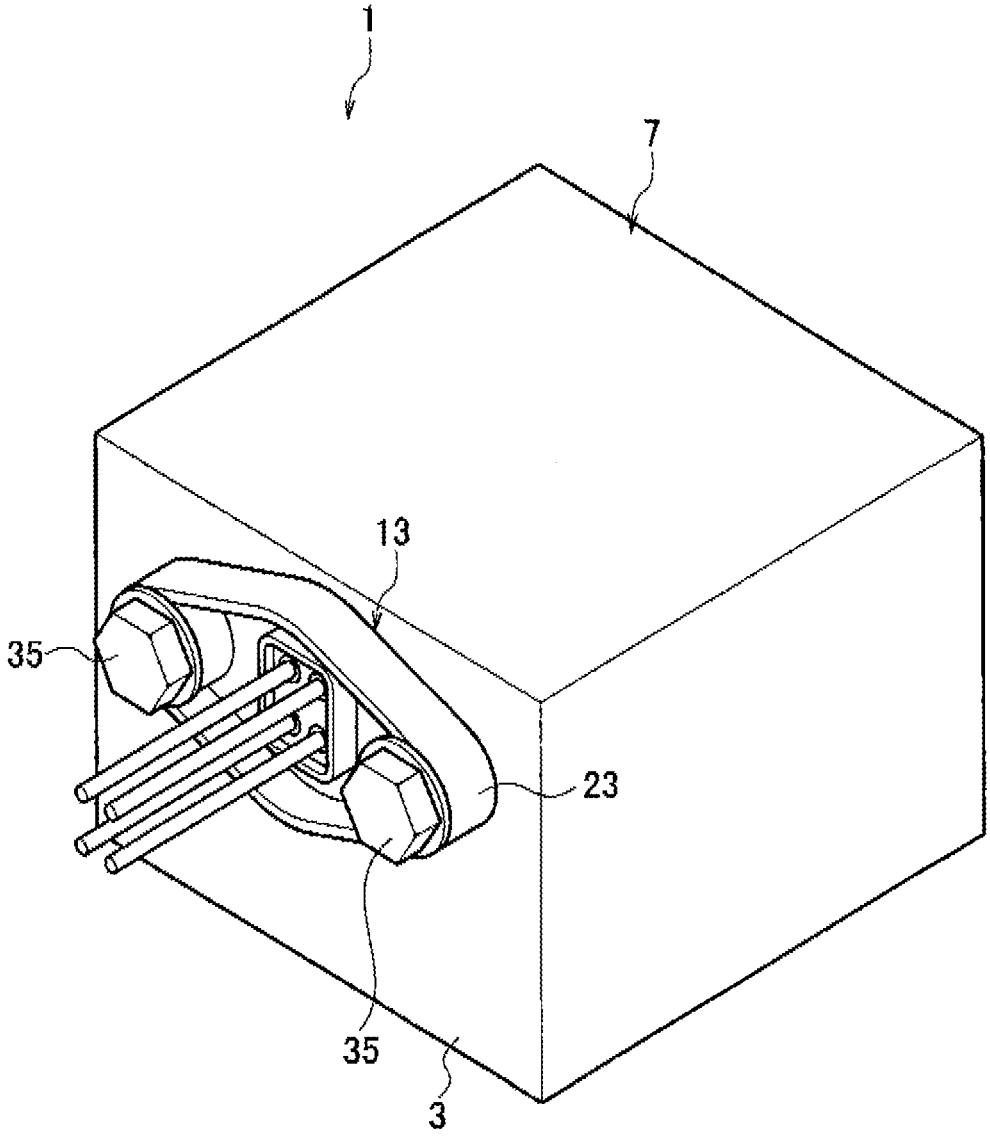
FIG. 1 is a perspective view of a connector according to an embodiment of the present invention.
Figure 2:
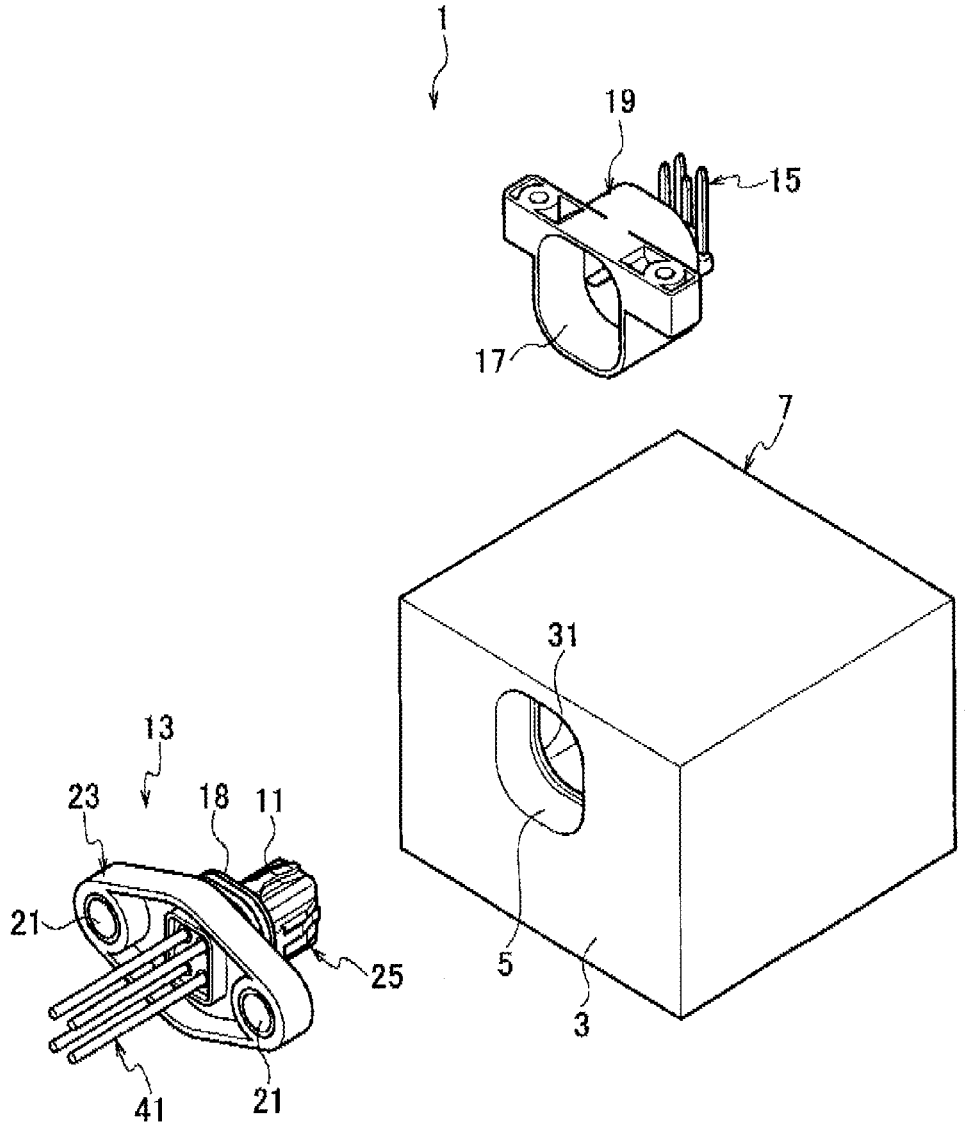
FIG. 2 is an exploded perspective view of the connector according to the embodiment of the present invention.

A description is given of a connector according to an embodiment of the present invention with reference to FIGS. 1 to 8B.

A connector 1 according to the embodiment includes a case-shaped attachment member 7, a first housing 13, a second housing 19, and a first seal member 18. The attachment member 7 includes a through-hole 5 in a sidewall 3. The first housing 13 is provided outside of the attachment member 7 and includes a first fitting portion 11 accommodating first terminals 9. The second housing 19 is provided within the attachment member 7 and includes a second fitting portion 17. The second fitting portion 17 is capable of being fitted to the first fitting portion 11 inserted through the through-hole 5 and accommodates second terminals 15. The first seal member 18 is provided in close contact with the outer periphery of the first housing 13 and is brought into close contact with the through-hole 5 for sealing the inside of the attachment member 7 from the outside thereof.

The first housing 13 includes an outer housing 23 and an inner housing 25. The outer housing 23 includes fixation portions 21 which are fixed to the sidewall 3 of the attachment member 7. The inner housing 25 is assembled to the inner peripheral side of the outer housing 23 to be movable in the direction that the first housing 13 is fitted to the second housing 19 (hereinafter, sometimes just referred to as a fitting direction) and is provided with the first fitting portion 11.

The inner housing 25 is provided with a pressing rib 27 on the outer periphery of the first fitting portion 11. The pressing rib 27 has an outer diameter small enough to be inserted into the through-hole and is located facing an end surface 28 of the outer housing 23 in the fitting direction.

Between the end surface 28 of the outer housing 23 in the fitting direction and the surface of the pressing rib 27 facing the end surface 28, a second seal member 29 is provided. The second seal member 29 is in close contact with the pressing rib 27 and the end surface of the outer housing 23 in the fitting direction for sealing between the outer housing 23 and the inner housing 25.

In a side of the through-hole 5 closer to the inside of the attachment member 7, a restricting portion 31 is provided. The restricting portion 31 comes into contact with the pressing rib 27 to restrict movement of the pressing rib 27 in the fitting direction.

The restricting portion 31 is formed into a flange thinner than the sidewall 3 at an open end of the through-hole 5 closer to the inside of the attachment member 7.

As illustrated in FIGS. 1 to 8B, the attachment member 7 is formed into a case and accommodates instruments (not shown) and the like inside. The attachment member 7 is provided with the through-hole 5 penetrating the sidewall 3 to connect the inside and outside. In the through-hole 5, the first fitting portion 11 of the first housing 13 is inserted from the outside toward the inside.

The first housing 13 is composed of the outer and inner housings 23 and 25. The outer housing 23 is made of an insulating material such as synthetic resin and has a rhombus profile. The outer housing 23 is provided with the fixation portions 21 and an accommodation hole 33.

The fixation portions 21 are individually provided in both sides of the outer housing 23 and is composed of bolt insertion holes through which bolts 35 are inserted. By fastening the bolts 35 through the fixation portions 21 in the state where the first fitting portion 11 of the first housing 13 is fitted to the second fitting portion 17 of the second housing 19, the outer housing 23 is fixed to the sidewall 3 of the attachment member 7.

When the fixation portions 21 are fixed to the attachment member 7 as described above, external force applied to wires 41, such as tensile force, can be absorbed by the fixation portions 21. This can reduce the influence thereof on fitting between the first fitting portion 11 of the first housing 13 and the second fitting portion 17 of the second housing 19.

The accommodation hole 33 is provided at the center of the outer housing 23 to penetrate the outer housing 23. The accommodation hole 33 is extended by a member continuous to the outer housing 23 from the open end toward the through-hole 5 of the attachment member 7.

The extended portion of the accommodation hole 33 is located within the through-hole 5 of the attachment member 7 to communicate with the through-hole 5 when the outer housing is attached to the attachment member 7. Within the thus-configured accommodation hole 33 an inner housing 25 is accommodated.

The inner housing 25 is accommodated in the accommodation hole 33 of the outer housing 23 to be movable in the direction that the first housing 13 is fitted to the second housing 19. The inner housing 25 is provided with the first fitting portion 11.

The inner housing 25 is provided with engagement grooves 39 extending in the fitting direction. The engagement grooves 39 are engageable with engagement arms 37 which are provided on the inner surface of the accommodation hole 33 of the outer housing 23 to freely bend. The engagement grooves and arms 39 and 37 prevent the inner housing 25 assembled to the outer housing 23 from being detached.

The first fitting portion 11 is formed into a case to be inserted into the through-hole 5 of the attachment member 7. When a part of the inner housing 25 which is located to a side of the first fitting portion 11 closer to the cuter housing 23 is accomodated in the accommodation hole 33, the first fitting portion 11 is located ahead of the extended portion of the accommodation hole 33 in the fitting direction.

In the process of fitting the first housing 13 to the second housing 19, the first fitting portion 11 is inserted into the through-hole 5 of the attachment member 7. The first fitting portion 11 thus configured accommodates the first terminals 9 inside, each first terminal 9 being composed of a female terminal and including a box-shaped connection portion.

The first terminals 9 are made of a conductive material. The first terminals 9 are electrically connected to respective terminals of plural wires 41 connected to devices and power supplies (not shown) and are prevented by locking lances 43, which are provided within the first fitting portion 11 to freely bend, from being detached.

On the wire 41 connected to each first terminal 9, a third seal member 45 is provided. The third seal member 45 is attached to the outer periphery of the wire 41 in close contact with the same. The third seal members 45 are in close contact with the inner circumferential surfaces in the first fitting portion 11 for sealing between the inside and outside of the first fitting portion 11 when the first terminals 9 are accommodated in the first fitting portion 11.

When the first fitting portion 11 is inserted into the through-hole 5 of the attachment member 7 and is fitted to the second fitting portion 17 of the second housing 19, the connecting portions of the second terminals 15 accommodated within the second fitting portion 17 are inserted into the respective first terminals 9, thus forming electrical connection between the first and second terminals 9 and 15.

The second housing 19 is made of an insulating material such as synthetic resin and is formed into a case. The second housing 19 is opened at an end and is provided with the second fitting portion 17 inside, which is fitted to the first fitting portion 11 of the first housing 13.

The second housing 19 is placed on the surface of a substrate 47, which is a circuit board with electronic parts (not shown) and the like mounted thereon, and is fixed to the substrate 47 with a fixing member (not shown) such as a screw. Within the thus-configured second fitting portion 17 of the second housing 19, the connecting portions of the second terminals 15 are arranged.

The second terminals 15 are made of a conductive material and are L-shaped. An end of each second terminal 15 includes a tab-shaped connecting portion placed within the second fitting portion 17. The other end of the second terminal 15 includes a substrate connecting portion which is electrically connected to a conductor portion of the substrate 47 by soldering or the like.

The second housing 19 accommodating the second terminals 15 is assembled to the substrate 47 and is then accommodated within the attachment member 7. In this state, the opening of the second fitting portion 17 of the second housing 19 is located at the through-hole 5 of the attachment member 7. When the first housing 13 is inserted into the through-hole 5, the first fitting portion 11 is fitted to the second fitting portion 17, and the first and second terminals 9 and 15 are electrically connected.

In the thus-configured connector 1, a first seal member 18 for sealing between the inside and outside of the attachment member 7 is provided between the attachment member 7 and first housing 13. A second seal member 29 for sealing between the inside and outside of the inner housing 25 is provided between the outer and inner housings 23 and 25. This prevents water and the like from entering into the attachment member 7 and inner housing 25 from the outside.

The first seal member 18 is made of an elastic material such as rubber and is formed into a ring. The first seal member 18 is attached to the outer periphery of the extended portion of the accommodation hole 33 of the outer housing 23 of the first housing 13 in close contact with the same. The outer diameter of the first seal member 18 is set larger than the inner diameter of the through-hole 5 of the attachment member 7.

When the extended portion of the accommodation hole 33 of the outer housing 23 is inserted into the through-hole 5 of the attachment member 7, the outer circumferential surface of the first seal member 18 comes into close contact with the inner circumferential surface of the through-hole 5. By the assembly of the first seal member 18 to the through-hole 5, the inside of the attachment member 7 is sealed from the outside thereof, ensuring the sealing performance between the attachment member 8 and the first housing 13.

Figure 8A:
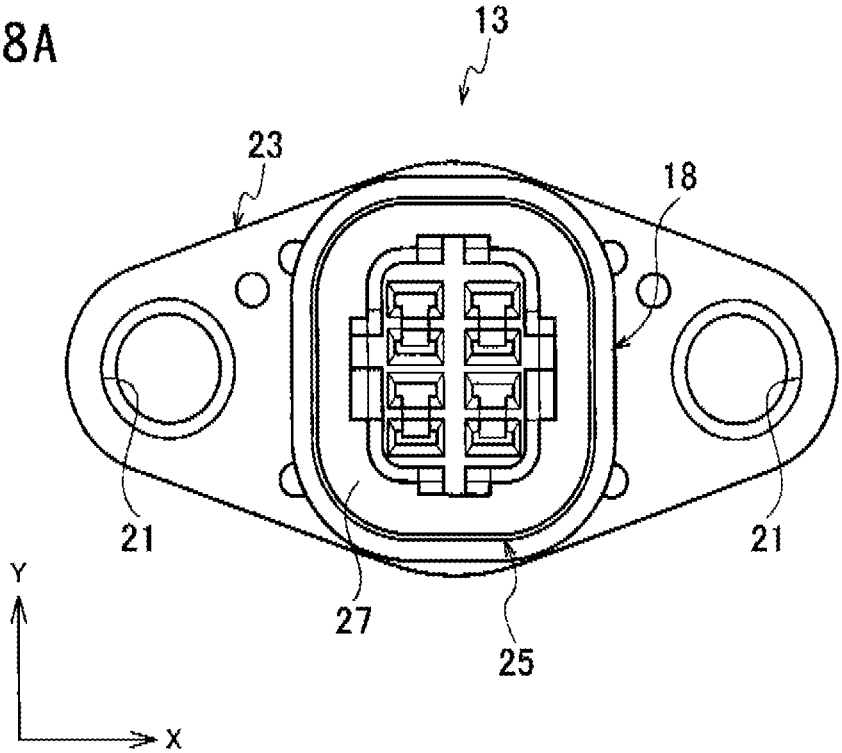
FIG. 8A is a front view of the first housing to which a first seal member is assembled in the connector according to the embodiment of the present invention.

Herein, the first seal member 18 has a function to align the axes of the first and second fitting portions 11 and 17 in the direction, orthogonal to the fitting direction of the first and second housings 13 and 19 (in the planar direction defined by directions X and Y illustrated in FIG. 8A).

Figure 8B:
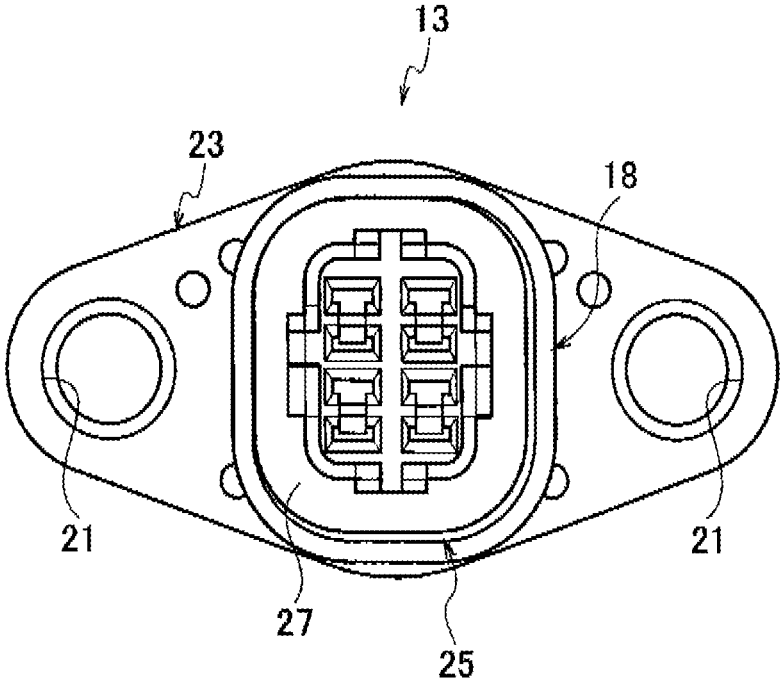
FIG. 8B is a front view of the first housing when the misalignment of the second housing with respect to an attachment member is absorbed by the first seal member after the state of FIG. 8A.

To be specific, when the opening of the second fitting portion 17 of the second housing 19 is misaligned with the through-hole 5 of the attachment member 7 in the direction orthogonal to the fitting direction, the misalignment in the same direction can be absorbed by changing the amount by which the first seal member 18 is compressed as illustrated in FIG. 8B.

The opening of the second fitting portion 17 of the second housing 19 is typically misaligned with the through-hole 5 of the attachment member 7 by a very small amount in the direction orthogonal to the fitting direction. If the opening of the second fitting portion 17 of the second housing 19 is misaligned with the through-hole 5 of the attachment member 7 in the direction orthogonal to the fitting direction because of changing the layout within the attachment member 7, it is more easy to change the position of the through-hole 5 of the attachment member 7 so that the through-hole 5 is aligned with the opening of the second fitting portion 17 of the second housing 19.

The misalignment of the opening of the second fitting portion 17 with the through-hole 5 in the direction orthogonal to the fitting direction can be therefore sufficiently absorbed by the interference of the first seal member 18 without applying a complicated structure, thus reducing the cost.

On the other hand, the opening of the second fitting portion 17 of the second housing 19 is sometimes misaligned with the through-hole 5 of the attachment member 7 in the fitting direction because of changing the layout inside the attachment member 7.

In this case, the misalignment of the opening of the second fitting portion 17 with the through-hole 5 of the attachment member 7 cannot be absorbed even by changing the position of the through-hole 3. In the first housing 13, therefore, the inner housing 25 provided, with the first fitting portion 11 is assembled to the accommodation hole 33 of the outer housing 23 to move in the direction that the first housing 13 is fitted to the second housing 19.

Even when the opening of the second fitting portion 17 is misaligned with the through-hole 5 in the fitting direction, the inner housing 25 moves in the fitting direction to absorb the misalignment, so that the first and second fitting portions 11 and 17 can be fitted to each other.

The end surface 28 of the accommodation hole 33 of the outer housing 23, which holds the thus-configured inner housing 25, in the fitting direction is provided with an annular accommodation groove 49. Moreover, the annular pressing rib 27, which has an outer diameter small enough to be inserted into the through-hole 5 and is located to face the accommodation groove 49, is protruded outward, on the outer periphery of the inner housing 25. The second seal member 29 is provided between the pressing rib 27 and accommodation groove 49.

The second seal member 29 is made of an elastic material such as rubber and is formed into a ring. The second seal member 29 is attached within the accommodation groove 49 of the outer housing 23 in close contact with the same, and the portion of the second seal member 29 exposed to the outside of the accommodation groove 49 is in close contact with the pressing rib 27 of the inner housing 25.

In the process of fitting the first fitting portion 11 of the first housing 13 to the second fitting portion 17 of the second housing 19, the surfaces of the first and second fitting portions 11 and 17 facing each other in the fitting direction come into contact each other to restrict the movement of the inner housing 25 in the fitting direction. The second seal member 29 is compressed by the pressing rib 27 toward the inside of the accommodation groove 49 to come into close contact with the pressing rib 27 and accommodation groove 49.

By the above-described close contact between the pressing rib 27 of the second seal member 29 and the accommodation groove 49, the inside of the inner housing 25 is sealed from the outside thereof, thus ensuring the sealing performance between the outer and inner housings 23 and 25.

Herein, in the process of fitting the first fitting portion 11 of the first housing 13 to the second fitting portion 17 of the second housing 19, when the second fitting portion 17 of the second housing 19 is located away from the through-hole 5 of the attachment member 7 in the fitting direction, for example, the surfaces of the first and second fitting portions 11 and 17 facing each other in the fitting direction cannot come into contact, and the movement of the inner housing 25 in the fitting direction cannot be restricted.

In this case, the pressing force applied by the pressing rib 27 to the second seal member 29, which is placed between the pressing rib 27 and accommodation groove 49, is reduced, and the second seal member 29 cannot come into sufficiently close contact with the pressing rib 27 and accommodation groove 49. The sealing performance of the second seal member 29 can be therefore reduced.

Accordingly, the through-hole 5 of the attachment member 7 is provided with the restricting portion 31 inside, which comes into contact with the pressing rib 27 to restrict the movement of the pressing rib 27 in the fitting direction. The restricting portion 31 is formed into a flange thinner than the sidewall 3 at the open end of the through-hole 5 closer to the inside of the attachment member 7.

When the restricting portion 31 is formed into such a thin flange at the open end of the through-hole 5 closer to the inside of the attachment member 7, the restricting portion 31 does not protrude into the attachment member 7 and does not influence the layout within the attachment member 7. In addition, since the restricting portion 31 is provided at the open end of the through-hole 5 closer to the inside of the attachment member 7, the first fitting portion 11 of the inner housing 25 is movable in the fitting direction within the through-hole 5.

Even when the surfaces of the first and second fitting portions 11 and 17 facing each other in the fitting direction do not come into contact with each other because of the restricting portion 31, the restricting portion 31 comes into contact with the pressing rib 27 to restrict the movement of the inner housing 25 in the fitting direction, and the second seal member 29 is brought into close contact with the pressing rib 27 and accommodation groove 49. The sealing performance between the outer and inner housings 23 and 25 is therefore ensured.

Figure 3:
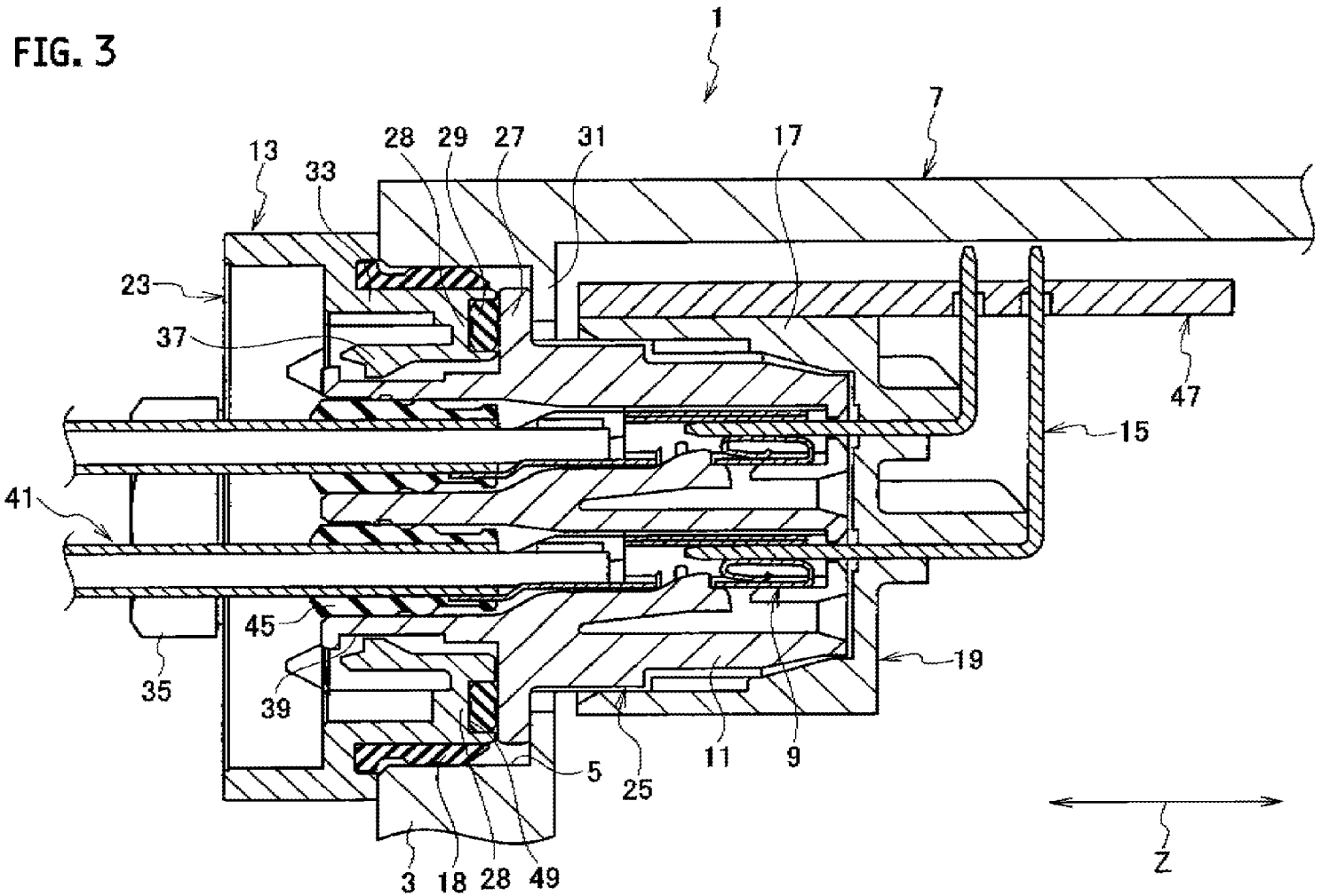
FIG. 3 is a cross-sectional view of the connector according to the embodiment of the present invention.
Figure 4A:
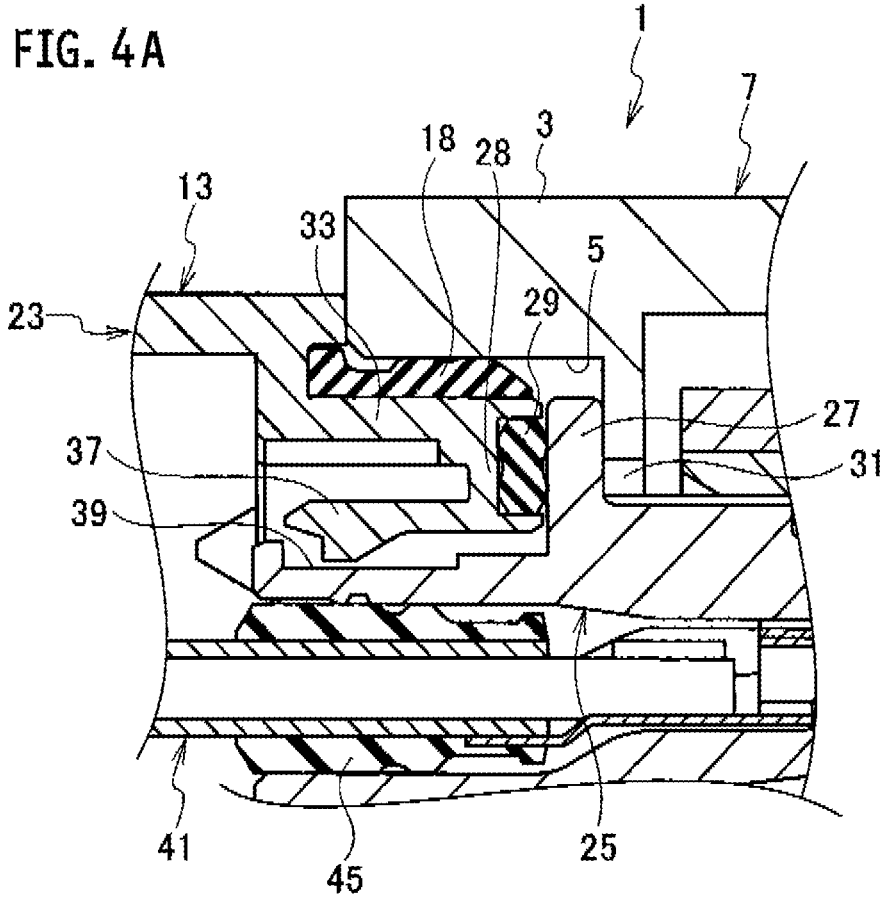
FIGS. 4A and 4B are enlarged views of major portions of FIG. 3.
Figure 4B:
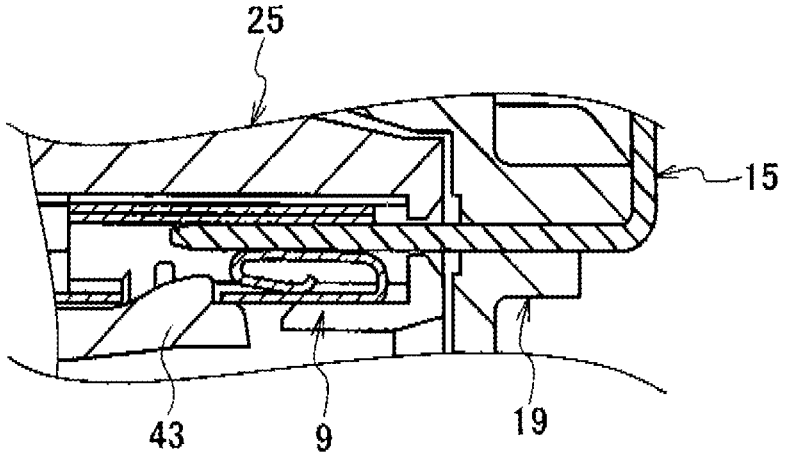
Figure 5A:
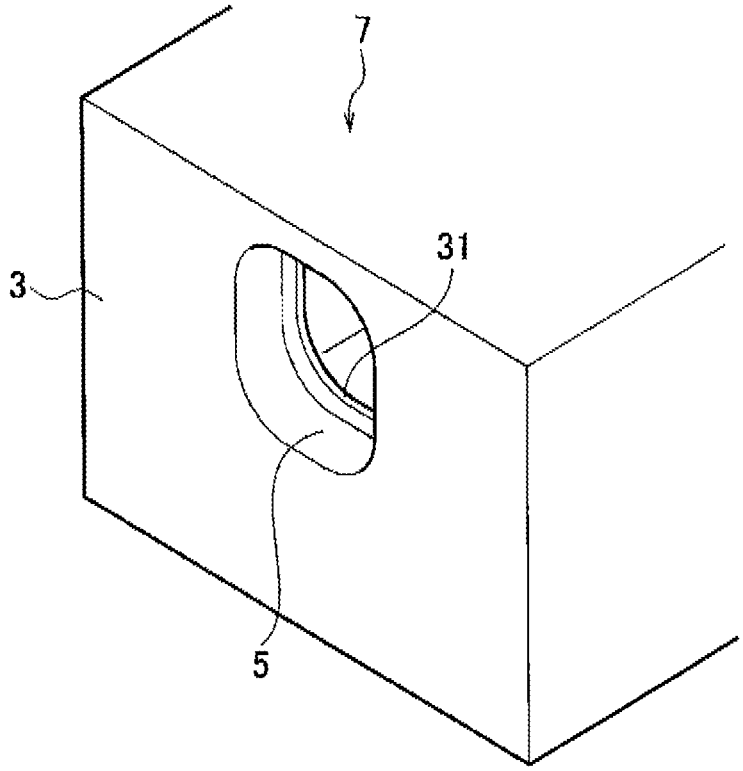
FIGS. 5A and 5B are respectively a perspective view and a cross-sectional view of the connector according to the embodiment of the present invention.
Figure 5B:
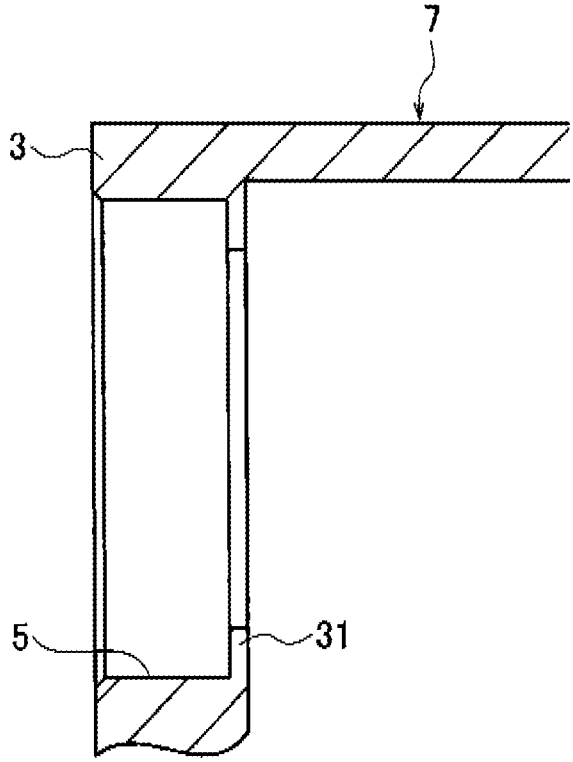
Figure 6:
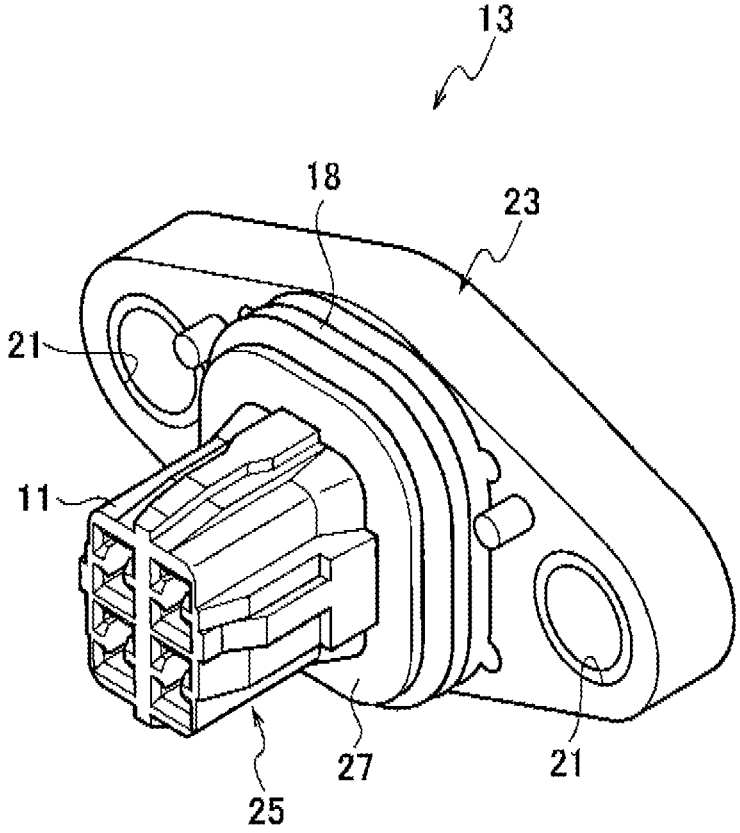
FIG. 6 is a perspective view of a first housing of the connector according to the embodiment of the present invention.
Figure 7:
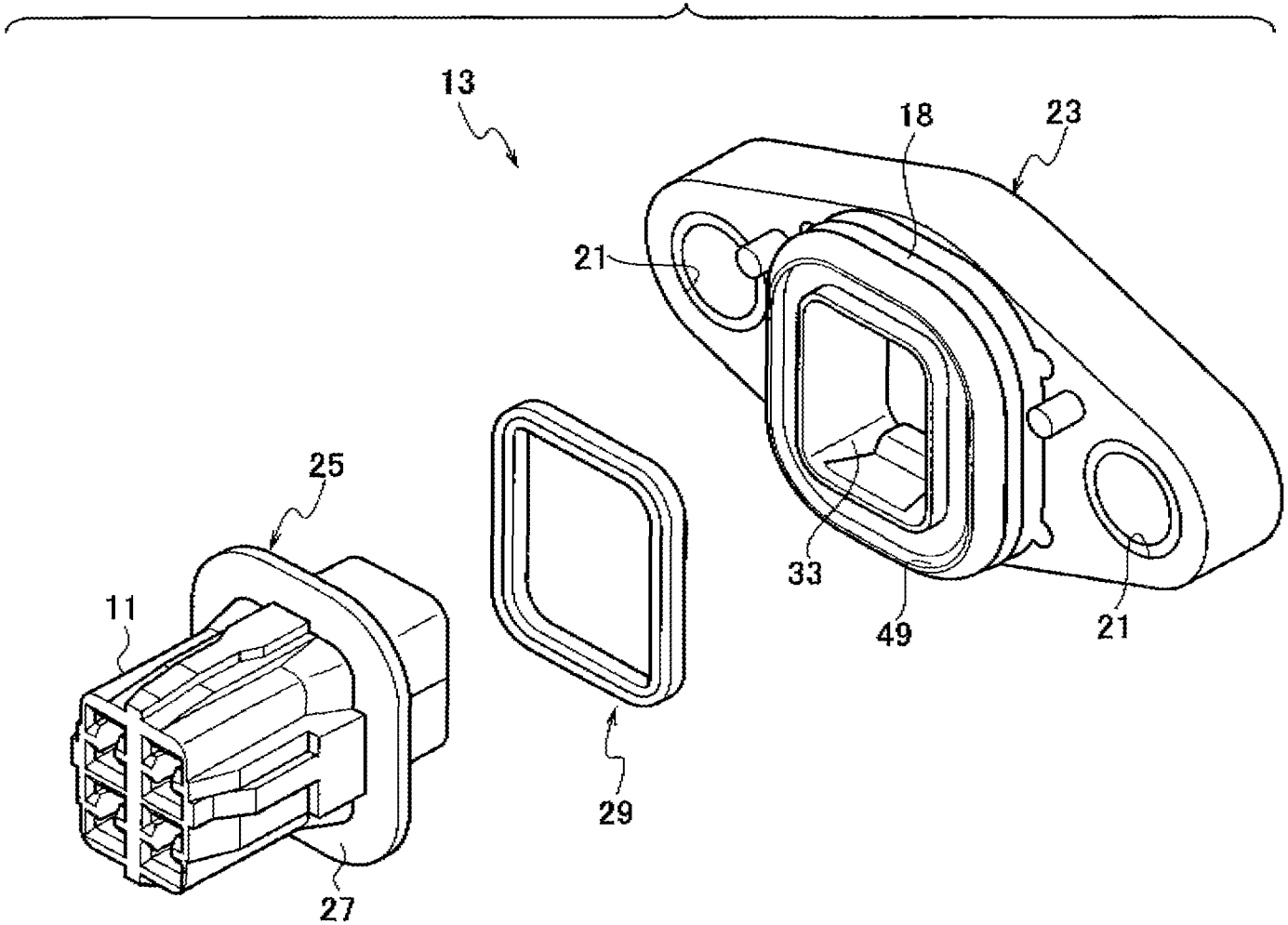
FIG. 7 is an exploded perspective view of the first housing of the connector according to the embodiment of the present invention.

For the inner housing 25 provided with the fitting portion 11 is movable in the fitting direction and the restricting portion 31 which can come into contact with the pressing rib 27 is provided for the through-hole 5, the function of aligning the axes of the first and second fitting portions 11 and 17 can be provided with regard to the direction that the first housing 13 is fitted to the second housing 19 (a direction Z indicated in FIG. 3). Moreover, the sealing performance of the second seal member 29 is ensured.

In the thus-configured connector 1, the first housing 13 includes the inner housing 25, which is attached to an inner peripheral side of the outer housing 23 to move in the direction that the first housing 13 is fitted to the second housing and is provided with the first fitting portion 11. The inner housing 25 is provided with the pressing rib 27, which has an outer diameter small enough to be inserted into the through-hole and is located facing the end surface 28 of the outer housing 23 in the fitting direction, on the outer periphery of the first fitting portion 11.

Accordingly, the first fitting portion 11 of the inner housing 25 is movable relative to the second fitting portion 17 of the second housing 19 in the fitting direction and can absorb the misalignment of the second housing 19 with the attachment member 7 in the fitting direction, so that the first and second terminals 9 and 15 can be properly connected.

Moreover, the second seal member 29, which comes into close contact with the pressing rib 27 and the end surface 28 of the outer housing 23 in the fitting direction for sealing between the outer and inner housings 23 and 25, is provided between the end surface 28 and the surface of the pressing rib 27 facing the end surface 28.

When the second housing 19 is misaligned with the attachment member 7 towards the through-hole 5 in the fitting direction, the surfaces of the first and second fitting portions 11 and 17 facing each other in the fitting direction come into contact with each other to restrict the movement of the inner housing 25 in the fitting direction. The second seal member 29 therefore comes into close contact with the surfaces of the pressing rib 27 and the outer housing 23 facing each other in the fitting direction, thus ensuring the sealing performance.

The restricting portion 31, which comes into contact with the pressing rib 27 to restrict the movement of the pressing rib 27 in the fitting direction, is further provided in the side of the through-hole 5 closer to the inside of the attachment member 7. This can restrict the movement of the inner housing 25 in the fitting direction even when the surfaces of the first and second fitting portions 11 and 17 facing each other in the fitting direction are not in contact with each other.

When the second housing 19 is misaligned with the attachment member 7 away from the through-hole 5 in the fitting direction, the pressing rib 27 comes into contact with the restricting portion 31 to restrict the movement of the inner housing 25 in the fitting direction. The second seal member 29 is therefore brought into close contact with the surfaces of the pressing rib 27 and inner housing 25 facing each other in the fitting direction, thus ensuring the sealing performance.

According to the above-described connector 1, it is possible to ensure the sealing performance of the second seal member 29 while absorbing misalignment of the second housing 19 with the attachment member 7 in the fitting direction, thus increasing the reliability in connection between the first and second terminals 9 and 15.

Moreover, the restricting portion 31 is formed into the flange thinner than the sidewall 3 at the open end of the through-hole 5 closer to the inside of the attachment member 7. The restricting portion 31 does not protrude into the attachment member 7 and cannot influence the arrangement space within the attachment member 7.

In the connector according to the embodiment of the present invention, the restricting portion is provided at the open end of the through-hole closer to the inside of the attachment member. The restricting portion needs to be located in the side of the through-hole closer to the inside of the through-hole but does not need to be provided at the open end.

In addition, the restricting portion is formed into a thin flange. However, the present invention is not limited thereto. The restricting portion may include plural protrusions arranged in the circumferential direction of the through-hole. The restricting portion may have any profile as long as the restricting portion can restrict the movement of the pressing rib in the fitting direction.

Moreover, the fixation portion of the first housing is fixed to the sidewall of the attachment member with a bolt, but the present invention is not limited thereto. The fixation portion may be fixed to the sidewall of the attachment member by an adhesion means or an engagement means.

What is claimed is:

1. A connector, comprising:

a case-shaped attachment member including a through-hole in a sidewall;

a first housing which is provided outside of the attachment member and includes a first fitting portion accommodating a first terminal, the first fitting portion being inserted through the through-hole;

a second housing which is provided inside of the attachment member and includes a second fitting portion which is capable of being fitted to the first fitting portion and accommodates a second terminal; and a first seal member which is provided in close contact with an outer periphery of the first housing and is brought into close contact with the through-hole for sealing between the inside and outside of the attachment member, wherein the first housing includes: an outer housing provided with a fixation portion which is fixed to the sidewall of the attachment member; and an inner housing which is provided on an inner peripheral side of the outer housing to move in a fitting direction that the first housing is fitted to the second housing and includes the first fitting portion, the inner housing is provided with a pressing rib on an outer periphery of the first fitting portion, the pressing rib having an outer diameter small enough to be inserted through the through-hole and being located facing an end surface of the outer housing in the fitting direction, a second seal member is provided between the end surface of the outer housing in the fitting direction and a surface of the pressing rib facing the end surface, the second seal member coming into close contact with the pressing rib and the can surface of the outer housing in the fitting direction for sealing between the outer housing and the inner housing, and a restricting portion is provided in a side of the through-hole closer to the inside of the attachment member, the restricting portion being configured to come into contact with the pressing rib to restrict movement of the pressing rib in the fitting direction.

2. The connector according to claim 1, wherein the restricting portion is formed into a flange thinner than the sidewall at an open end of the through-hole closer to the inside of the attachment member.

* * * * *